US007498997B2

(12) United States Patent
Moon et al.

(10) Patent No.: US 7,498,997 B2
(45) Date of Patent: Mar. 3, 2009

(54) PLATE BOARD TYPE MIMO ARRAY ANTENNA INCLUDING ISOLATION ELEMENT

(75) Inventors: Young-min Moon, Seoul (KR); Young-eil Kim, Suwon-si (KR); Kyeong-sik Min, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 131 days.

(21) Appl. No.: 11/436,486

(22) Filed: May 19, 2006

(65) Prior Publication Data

US 2006/0279465 A1 Dec. 14, 2006

(30) Foreign Application Priority Data

Jun. 13, 2005 (KR) ..... 10-2005-0050636

(51) Int. Cl.
*H01Q 1/38* (2006.01)
*H01Q 1/52* (2006.01)
*H01Q 19/10* (2006.01)

(52) U.S. Cl. ..... 343/834; 343/700 MS; 343/841; 343/844

(58) Field of Classification Search ..... 343/795, 343/841, 700 MS, 824–826, 829, 830, 834, 343/844, 853, 893
See application file for complete search history.

(56) References Cited

U.S. PATENT DOCUMENTS 5,039,994 A * 8/1991 Wash et al. ..... 343/813
6,061,024 A * 5/2000 McGirr et al. ..... 343/700 MS
6,069,586 A * 5/2000 Karlsson et al. ..... 343/700 MS
6,218,989 B1 * 4/2001 Schneider et al. ..... 343/700 MS
6,473,040 B1 * 10/2002 Nakamura ..... 343/700 MS
6,795,021 B2 * 9/2004 Ngai et al. ..... 343/700 MS

FOREIGN PATENT DOCUMENTS

| | | | |
|---|---|---|---|
| EP | 0720252 | A | 7/1996 |
| EP | 0847101 | A | 6/1998 |
| EP | 1434301 | A | 6/2004 |
| JP | 10-200326 | A | 7/1998 |
| JP | 2003-258548 | A | 9/2003 |
| JP | 2003326955 | A | 11/2003 |
| WO | WO 2004/017462 | A | 2/2004 |

* cited by examiner

*Primary Examiner*—Michael C Wimer
(74) *Attorney, Agent, or Firm*—Sughrue Mion, PLLC

(57) ABSTRACT

A plate board type MIMO (multiple-input multiple-output) array antenna including a board, a plurality of antenna elements manufactured on the board, and an isolation unit offsetting effects of electromagnetic waves radiated from the plurality of antenna elements on the other antenna elements of the plurality of antenna elements. In a case where two antenna elements are used, the isolation unit may include at least one isolation element positioned within a space between the two antenna elements on the board and symmetric with respect to a center of a distance between the two antenna elements.

9 Claims, 11 Drawing Sheets

PLATE BOARD TYPE MIMO ARRAY ANTENNA INCLUDING ISOLATION ELEMENT

CROSS-REFERENCE TO RELATED APPLICATIONS

This application claims priority from Korean Patent Application No. 10-2005-0050636, filed Jun. 13, 2005 in the Korean Intellectual Property Office, the entire contents of which are incorporated herein by reference.

BACKGROUND OF THE INVENTION

1. Field of the Invention

Apparatuses consistent with the present invention relate to a Multiple-Input Multiple-Output (MIMO) array antenna, and more particularly, to a plate board type MIMO array antenna formed as a plate board type on a board and including an isolation element preventing an interference between antenna elements.

2. Description of the Related Art

Antennas are devices which convert electric signals into predetermined electromagnetic waves and radiate the electromagnetic waves to a free space or performing opposite operations. Patterns of effective areas onto or from which antennas can radiate or sense electromagnetic waves are generally referred to as radiation patterns. A plurality of antennas may be arrayed in a specific structure to combine radiation patterns and radiation powers of the antennas. Thus, the radiation patterns may be sharp, and electromagnetic waves of the antennas may be further radiated. An antenna having the above-described structure is referred to as an array antenna. Such an array antenna is used in an MIMO system performing a multiple-input multiple-output operation.

A plurality of antennas are used in an array antenna, and thus an interference may occur between the antennas. Thus, radiation patterns may be distorted or antenna elements may be combined with one another.

To prevent this, in a conventional MIMO array antenna, walls having three-dimensional structure are piled up between antenna elements arrayed on a board to prevent electromagnetic waves radiated from each of antennas from being propagated to another antenna. In this case, an interference between antennas may be prevented. However, a volume of an entire antenna chip is increased, and thus the entire antenna chip is difficult to use in a subminiature electronic apparatus. Also, it is difficult to manufacture the antenna chip.

SUMMARY OF THE INVENTION

The present invention provides a plate board type MIMO array antenna easily manufactured to be small in size and offsetting electromagnetic waves radiated from a plurality of antenna elements manufactured as plate board types on a board and propagated to other antenna elements of the plurality of antenna elements to prevent the plurality of antenna elements from interfering with each other so as to prevent radiation patterns from being distorted and increase an output gain.

According to an aspect of the present invention, there is provided a plate board type MIMO array antenna including: a board; a plurality of antenna elements manufactured on the board; and an isolation unit offsetting effects of electromagnetic waves radiated from the plurality of antenna elements on the other antenna elements of the plurality of antenna elements.

The plate board type MIMO array antenna may further include a plurality of feeders respectively feeding the plurality of antenna elements.

The plurality of antenna elements may be a first antenna element manufactured on the board and a second antenna element keeping at a predetermined distance from the first antenna element on the board.

The isolation unit may include an isolation element symmetric with respect to a center of a distance between the first and second antenna elements. The isolation element may be kept at a predetermined distance from the first and second antenna elements.

The isolation unit may include a plurality of isolation elements positioned within a space between the first and second antenna elements on the board, symmetric with respect to a center of a distance between the first and second antenna elements, and spaced apart from each other.

Each of the plurality of isolation elements may have a length corresponding to ½ of a distance between centers of the first and second antenna elements.

The plurality of antenna elements may be a first antenna element manufactured on the board, a second antenna element kept at a predetermined distance $\alpha$ from the first antenna element on the board, a third antenna element kept at a predetermined distance $\beta$ from the second antenna element in a perpendicular direction to a direction along which the first and second antenna elements are disposed, on the board, and a fourth antenna element kept at the predetermined distance $\beta$ from the first antenna element and at the predetermined distance $\alpha$ from the third antenna element on the board.

The isolation unit may include: a first isolation unit offsetting each of effects of electromagnetic waves radiated from the first and second antenna elements on the other antenna element of the first and second antenna elements; a second isolation unit offsetting each of effects of electromagnetic waves radiated from the third and fourth antenna elements on the other antenna of the third and fourth antenna elements; a third isolation unit offsetting each of effects of the electromagnetic waves radiated from the first and fourth antenna elements on the other antenna element of the first and fourth antenna elements; and a fourth isolation unit offsetting each of effects of the electromagnetic waves radiated from the second and third antenna elements on the other antenna element of the second and third antenna elements The first isolation unit may include a plurality of isolation elements positioned between the first and second antenna elements on the board, symmetric with respect to a center of a distance between the first and second antenna elements, and kept at a predetermined distance from each other.

The second isolation unit may include a plurality of isolation elements positioned between the third and fourth antenna elements, symmetric with respect to a center of a distance between the third and fourth antenna elements, and kept at a predetermined distance from each other.

The third isolation unit may include an isolation element symmetric with respect to a center of a distance between the first and fourth antenna elements. The fourth isolation unit may include an isolation element symmetric with respect to a center of a distance between the second and third antenna elements.

BRIEF DESCRIPTION OF THE DRAWINGS

The above and other aspects of the present invention will be more apparent by describing exemplary embodiments of the present invention with reference to the accompanying drawings, in which.

DETAILED DESCRIPTION OF EXEMPLARY EMBODIMENTS

Figure 1:
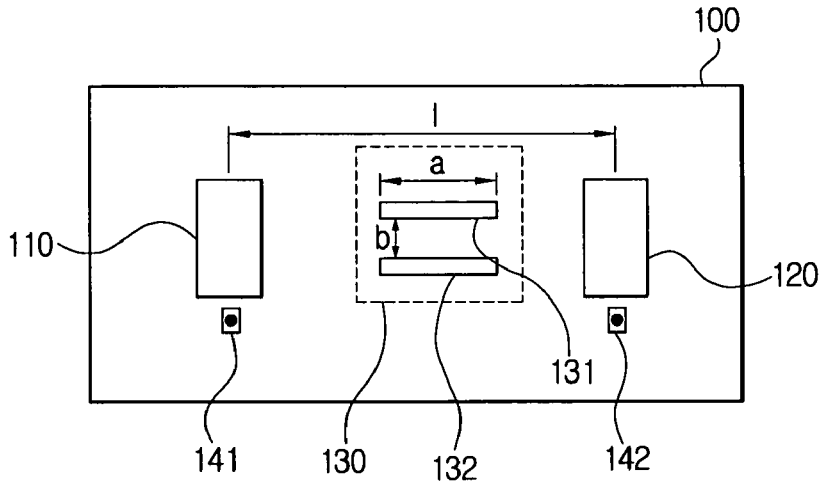
FIG. 1 is a view illustrating a configuration of a plate board type MIMO array antenna according to an exemplary embodiment of the present invention.

Exemplary embodiments of the present invention will be described in greater detail with reference to the accompanying drawings.

In the following description, same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

FIG. 1 is a view illustrating a configuration of a plate board type MIMO array antenna according to an exemplary embodiment of the present invention. Referring to FIG. 1, the plate board type MIMO array antenna includes first and second antenna elements 110 and 120 formed as plate board types on a board 100, an isolation unit 130, and two feeders 141 and 142.

The board 100 may be printed circuit board (PCB). Thus, a metal layer on a surface of the PCB may be removed to be a predetermined pattern so as to manufacture the first and second antenna elements 110 and 120 and the isolation unit 130 at a time. Since an additional material does not need to be stacked on the board 100 and a very thin metal layer constitutes the first and second antenna elements 110 and 120 and the isolation unit 130, the first and second antenna elements 110 and 120 may be realized as almost two-dimensional plate boards. Thus, a volume of the MIMO array antenna can be minimized. In this case, a distance between central points of the first and second antenna elements 110 and 120 may be ½ of a wavelength λ of a signal the MIMO array antennal desires to output.

The isolation unit 130 includes first and second isolation elements 131 and 132 symmetric with respect to a center of a distance between the first and second antenna elements 110 and 120. The first and second isolation elements 131 and 131 are disposed at a predetermined distance from each other within a space between the first and second antenna elements 110 and 120. The first and second isolation elements 131 and 132 are symmetric with respect to the center of the distance between the first and second antenna elements 110 and 120. The first and second isolation elements 131 and 132 may each be set to ¼ of a wavelength λ of an output signal.

As shown in FIG. 1, the first and second isolation elements 131 and 132 are bar-shaped so as to be disposed toward the first and second antenna elements 110 and 120 in long axis directions of bars of the first and second isolation elements 131 and 132. However, the first and second isolation elements 131 and 132 may be realized as only one isolation element. Also, as long as the first and second isolation elements 131 and 132 are symmetric, the first and second isolation elements 131 and 132 may be realized in other specific shapes and are not limited to bar shapes. Also, the isolation unit 130 includes the first and second isolation elements 131 and 132 as shown in FIG. 1 but may include one isolation element or three or more isolation elements. In this case, the one isolation element or the three or more isolation elements must be symmetric with respect to the center of the distance of the first and second antenna elements 110 and 120. A return-loss characteristic depending on a number of isolation elements will be described later in the present specification.

The two feeders 141 and 142 respectively feed the first and second antenna elements 110 and 120. As shown in FIG. 1, the feeders 141 and 142 are respectively spaced apart from the first and second antenna elements 110 and 120 under the first and second antenna elements 110 and 120. The feeders 141 and 142 are connected to a lower portion of the board 100 to be supplied with external electromagnetic energies. Thus, the external electromagnetic energies are coupled and then transmitted to the first and second antenna elements 110 and 120. As a result, the first and second antenna elements 110 and 120 respectively radiate electromagnetic waves.

If the first and second antenna elements 110 and 120 are positioned within a radiation area therebetween, the electromagnetic wave radiated from the first or second antenna element 110 or 120 is propagated to the other antenna element, i.e., the other one of the first or second antenna element. In this case, the electromagnetic wave radiated from the first antenna element 110 is propagated to the first and second isolation elements 131 and 132 and then to the second antenna element 120. Also, the electromagnetic wave radiated from the second antenna element 120 is also propagated to the first and second isolation elements 131 and 132. Thus, the first and second isolation elements 131 and 132 reflect the electromagnetic waves propagated from the first and second antenna elements 110 and 120 toward opposite directions to directions along which the electromagnetic waves are propagated from the first and second antenna elements 110 and 120. Therefore, effects of the electromagnetic waves propagated from the first and second antenna elements 110 and 120 on the antenna elements 110 and 120 respectively are offset. As a result, the first and second antenna elements 110 and 120 are electrically isolated from each other.

Figure 2:
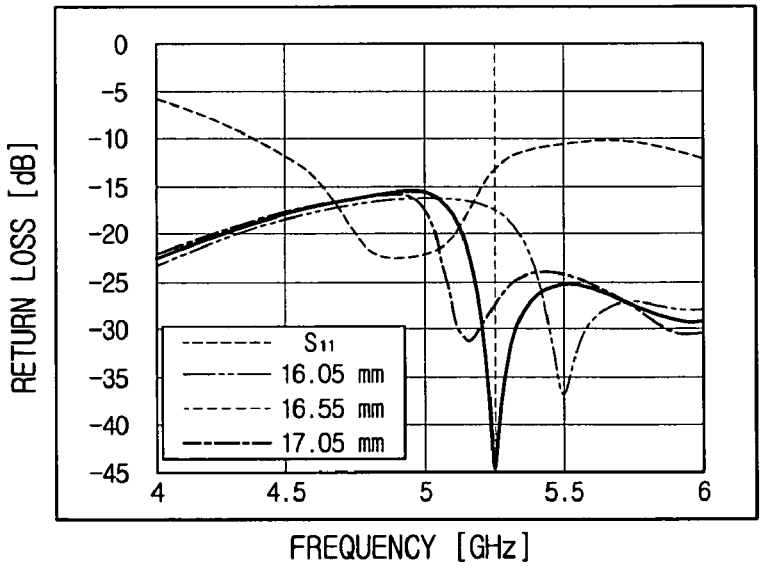
FIG. 2 is a graph illustrating a return-loss characteristic with respect to a frequency depending on lengths of first and second isolation elements in the plate board type MIMO array antenna of FIG. 1.

FIG. 2 is a graph illustrating a return-loss characteristic with respect to a frequency depending on lengths of the first and second isolation elements 131 and 132. FIG. 2 is generated based on conditions such that in the MIMO array antenna shown in FIG. 1, horizontal lengths of the first and second antenna elements 110 and 120 was each about 7 mm, vertical lengths of the first and second antenna elements 110 and 120 was each about 14.5 mm, the distance between the central points of the first and second antenna elements 110 and 120 was about 35 mm, vertical lengths of the first and second isolation elements 131 and 132 was each about 2.2 mm, and a distance between the first and second isolation elements 131 and 132 was about 11.8 mm, the return-loss characteristic was measured with respect to the frequency with varying lengths a of the first and second isolation elements 131 and 132.

Referring to FIG. 2, on a line graph S11 that is an S parameter indicating an input reflection coefficient, a maximum electromagnetic wave is radiated to the outside within a range between about 4.3 GHz and 5.5 GHz. The return-loss characteristic was observed with changing the length a of each of the first and second isolation elements 131 and 132 to 16.05 mm, 16.55 mm, and 17.05 mm. When the length a is 16.55 mm, the return-loss characteristic satisfies a central frequency between 5.15 GHz and 5.35 GHz. Also, when the length a is 16.55 mm, the return-loss is about −45 dB. Thus, an interference between the first and second antenna elements 110 and 120 is minimized so as to maximize an output gain of the plate board type MIMO array antenna. As described above, the plate board type MIMO array antenna shown in FIG. 1 adjusts lengths of the first and second isolation elements 131 and 132 so that a resonance occurs at a desired frequency. Thus, the characteristic of the plate board type MIMO antenna can be easily adjusted.

Figure 3:
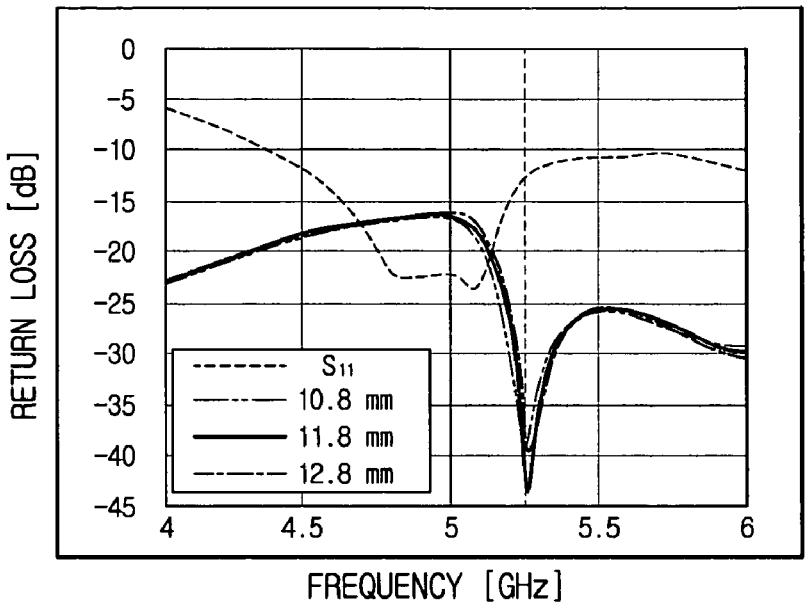
FIG. 3 is a graph illustrating a return-loss characteristic with respect to a frequency depending on a distance between first and second isolation elements in the plate board type MIMO array antenna of FIG. 1.

FIG. 3 is a graph illustrating a return-loss characteristic with respect to a frequency depending on a variation in the distance between the first and second isolation elements 131 and 132. When the length of each of the first and second isolation element 131 and 132 was 16.55 mm and the other conditions were the same as those of FIG. 2, the return-loss characteristic was measured with adjusting a distance b. Referring to FIG. 3, when the distance b is about 11.8 mm, the return-loss characteristic satisfies a central frequency between 5.15 GHz and 5.35 GHz.

Figure 4:
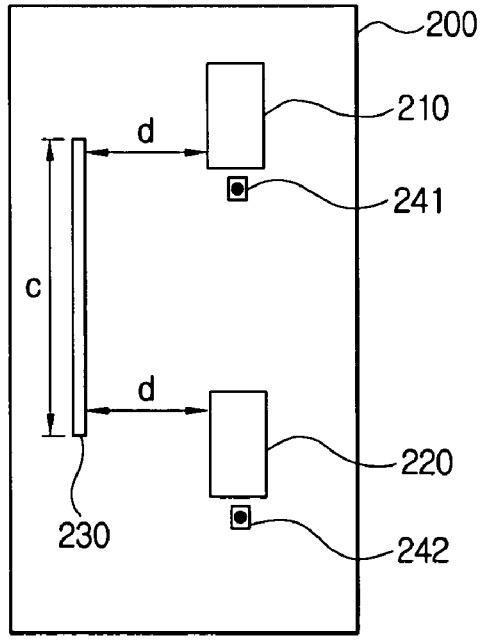
FIG. 4 is a view illustrating a configuration of a plate board type MIMO array antenna according to another exemplary embodiment of the present invention.

FIG. 4 is a view illustrating a configuration of a plat board type MIMO array antenna according to another exemplary embodiment of the present invention. Referring to FIG. 4, the plate board type MIMO array antenna includes first and second antenna elements 210 and 220 stacked on a board 200, an isolation unit 230, and first and second feeders 241 and 242.

In a case where the first and second antenna elements 210 and 220 are longitudinally disposed as shown in FIG. 4, the isolation unit 230 cannot be disposed between the first and second antenna elements 210 and 220 due to positions of the first and second feeders 241 and 242. In other words, if isolation elements are disposed as shown in FIG. 1, the isolation elements are not symmetric. As a result, electromagnetic waves are not offset.

In a case where the first and second antenna elements 210 and 220 are longitudinally disposed as shown in FIG. 4, the isolation unit 230 is disposed at a predetermined distance from the first and second antenna elements 210 and 220. In this case, the isolation unit 230 is kept at a distance d from each of the first and second antenna elements 210 and 220. The distance d may be about ¼ of a wavelength λ of a signal the plate board type MIMO array antenna desires to output.

The isolation unit 230 is realized as one element and is symmetric with respect to a center of a distance between the first and second antenna elements 210 and 220. The isolation unit 230 may be manufactured in one of other specific shape besides a bar shape as described above. An operation of the isolation unit 230 is the same as that of the isolation unit 130 shown in FIG. 1 and thus will not be described herein.

Figure 5:
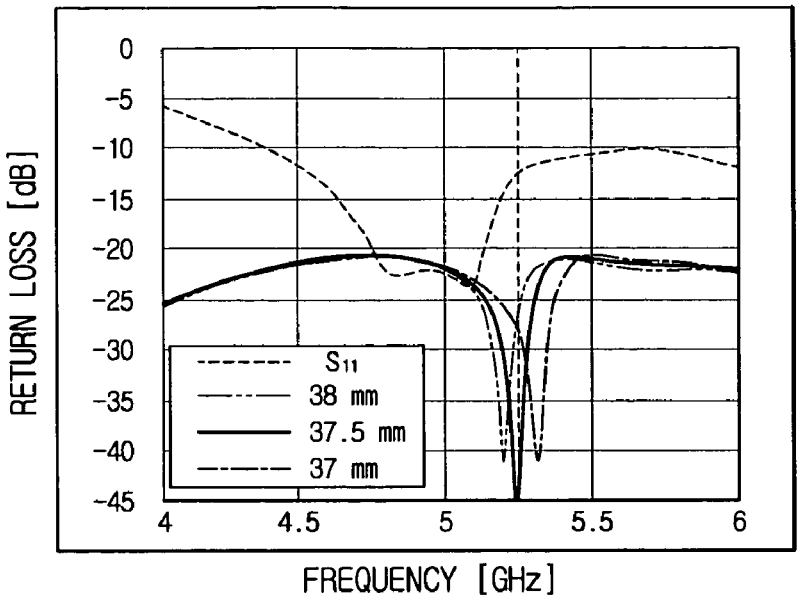
FIG. 5 is a graph illustrating a return-loss characteristic with respect to a frequency depending on lengths of first and second isolation elements in the plate board type MIMO array antenna of FIG. 4.

FIG. 5 is a graph illustrating a return-loss characteristic with respect to a frequency. When a distance d of the isolation unit 230 from the first and second antenna elements 210 and 220 was 15 mm and the other conditions were the same as those of FIG. 2 in the plate board type MIMO array antenna shown in FIG. 4, the return-loss characteristic was measured with changing a length c of the isolation unit 230 to 37 mm, 37.5 mm, and 38 mm. Referring to FIG. 5, on a line graph S11, a large amount of electromagnetic wave is radiated at a frequency between about 4.3 GHz and 5.5 GHz. Also, when the length c of the isolation unit 230 is 37.5 mm, the return-loss characteristic satisfies a central frequency of the plate board type MIMO array antenna between 5.15 GHz and 5.35 GHz.

Figure 6:
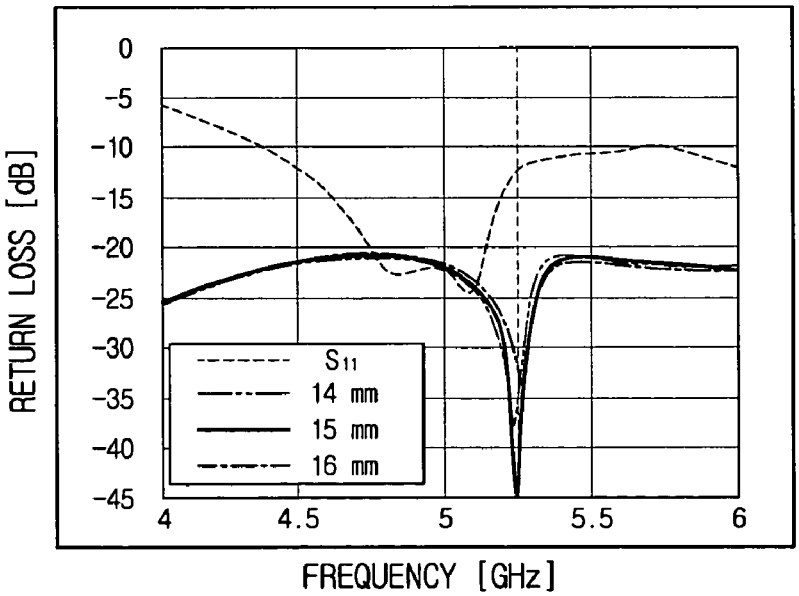
FIG. 6 is a graph illustrating a return-loss characteristic with respect to a frequency depending on a distance between first and second isolation elements in the plate board type MIMO array antenna of FIG. 4.

FIG. 6 is a graph illustrating a return-loss characteristic with respect to a frequency. The return-loss characteristic was measured with changing the distance d between the isolation unit 230 and the first and second antenna elements 210 and 220 to 14 mm, 15 mm, and 16 mm in the plate board type MIMO array antenna shown in FIG. 4. Referring to FIG. 6, when the distance d is about 15 mm, the return-loss characteristic satisfies a central frequency.

Figure 7A:
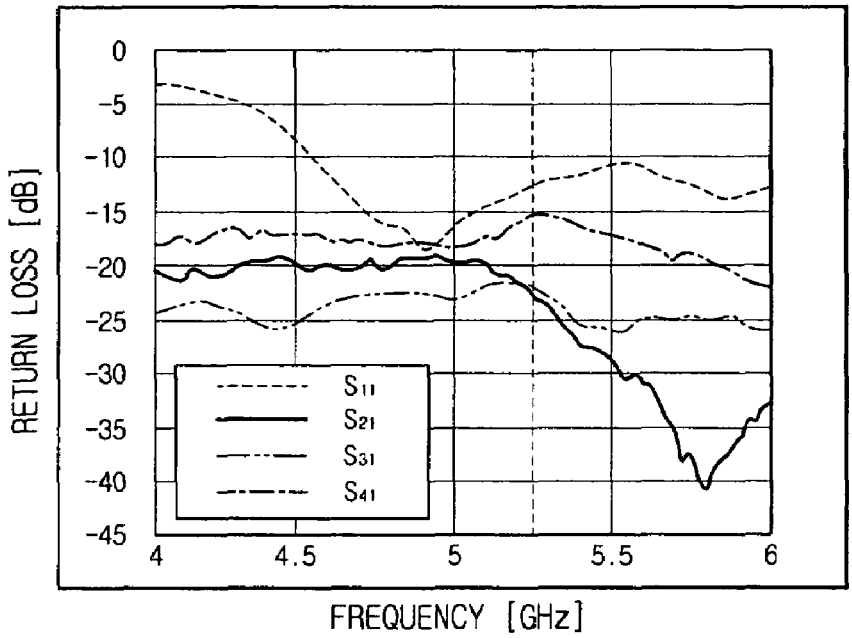
FIGS. 7A and 7B are graphs comparing a return-loss characteristic of a plate board type MIMO array antenna of an exemplary embodiment of the present invention with a return-loss characteristic of a conventional MIMO array antenna.
Figure 7B:
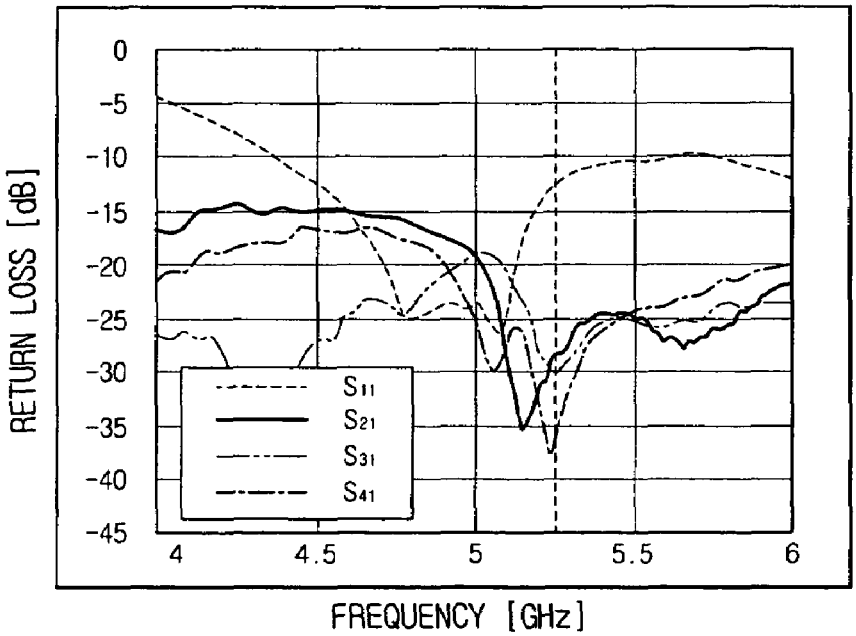

FIGS. 7A and 7B are graphs comparing a return-loss characteristic of a plate board type MIMO array antenna of the present invention with a return-loss characteristic of a conventional array antenna. FIG. 7A denotes a graph illustrating a return-loss characteristic of the conventional array antenna with respect to a frequency, and FIG. 7B denotes a graph illustrating a return-loss characteristic of the plate board type MIMO array antenna of an exemplary embodiment of the present invention with respect to a frequency.

On each of line graphs S21 of the graphs in FIGS. 7A and 7B, the return-loss characteristic is improved from −23.281 dB to −39.67 dB at a central frequency. Also, on each of line graphs S31, the return-loss characteristic is improved from −22.983 dB to −30.369 dB at the central frequency. On each of line graphs S41, the return-loss characteristic is improved from −15.145 dB to −37.549 dB at the central frequency.

Figure 8:
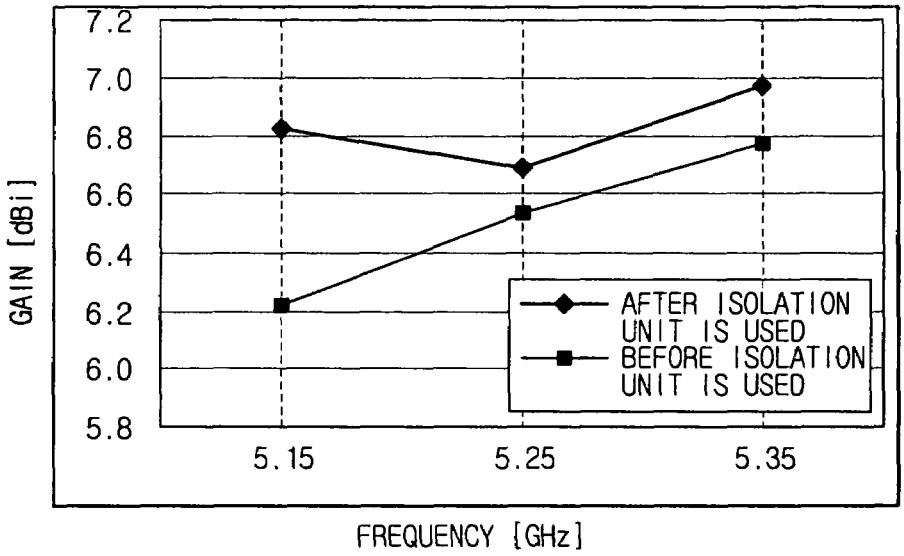
FIG. 8 is a graph illustrating an output gain characteristic of a plate board type MIMO array antenna of an exemplary embodiment of the present invention with an output gain characteristic of a conventional MIMO array antenna.

FIG. 8 is a graph illustrating a variation in an output gain with respect to a frequency. Referring to FIG. 8, a line graph illustrating an output gain of the conventional array antenna not including the isolation unit 130 or 230 is marked with "■", and a line graph illustrating an output gain of the plate board type MIMO array antenna of the present invention is marked with "◆." The output gain is increased at a central frequency between 5.15 GHz and 5.35 GHz with an improvement of return-loss by the isolation unit 130 or 230.

In the exemplary embodiments described with reference to FIGS. 1 and 4, two antenna elements are used. However, according to another exemplary embodiment of the present invention, two or more antenna elements may be used.

Figure 9:
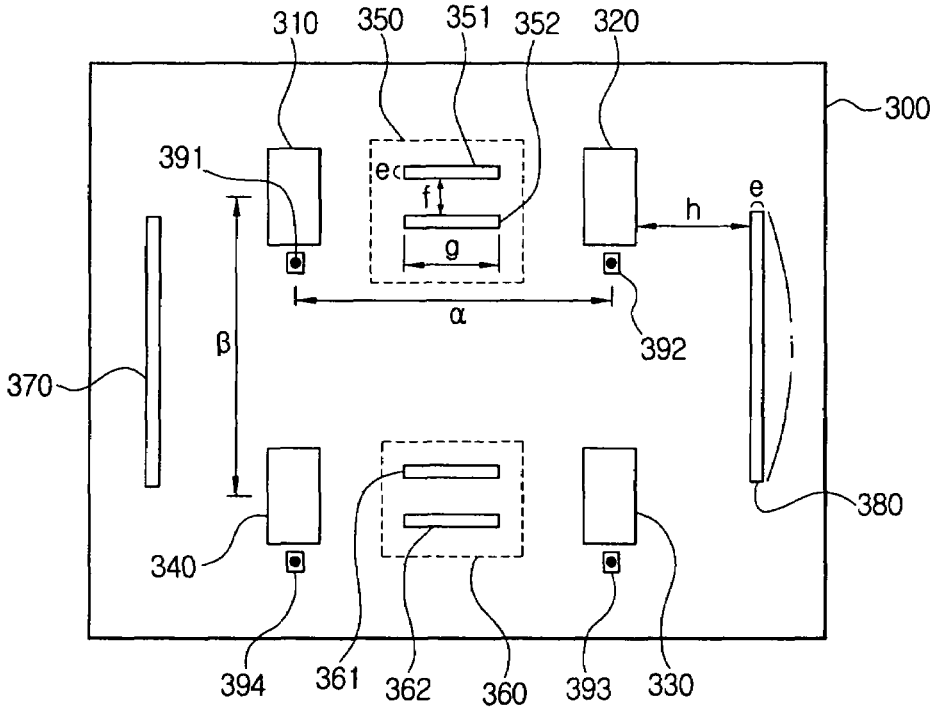
FIG. 9 is a view illustrating a configuration of a plate board type MIMO array antenna according to yet another exemplary embodiment of the present invention.

FIG. 9 is a view illustrating a configuration of a plate board type MIMO array antenna using four antenna elements according to still another exemplary embodiment of the present invention. Referring to FIG. 9, the plate board type MIMO array antenna includes first through fourth antenna elements 310 through 340, first through fourth isolation units 350 through 380, and first through fourth feeders 391 through 394.

The first through fourth antenna elements 310 through 340 are manufactured on a board 300. When a distance between the first and second antenna elements 310 and 320 is α, the third antenna element 330 is kept at a predetermined distance β from the second antenna element 320 in a perpendicular direction to a direction along which the first and second antenna elements 310 and 320 are disposed. Also, the fourth antenna element 340 is kept at a distance β from the first antenna element 310 and a distance α from the third antenna element 330. In other words, as shown in FIG. 9, the first through fourth antenna elements 310 through 340 are respectively manufactured on vertexes of a square having a predetermined size.

The first through fourth feeders 391 through 394 feeding the first through fourth antenna elements 310 through 340 are also manufactured on the board 300. In this case, positions of the first through fourth isolation units 350 through 380 are determined depending on positions of the first through fourth feeders 391 through 394.

In other words, if the first through fourth feeders 391 through 394 are respectively manufactured under the first through fourth antenna elements 310 through 340 as shown in FIG. 9, the first isolation unit 350 is positioned between the first and second antenna elements 310 and 320. As a result, the first isolation unit 350 prevents the first and second antenna elements 310 and 320 from interfering with each other.

The second isolation unit 360 is positioned between the third and fourth antenna elements 330 and 340 to prevent the third and fourth antenna elements 330 and 340 from interfering with each other. The first and second isolation units 350 and 360 may respectively include two isolation elements 351 and 352 and two isolation elements 361 and 362 or respectively include one or three or more isolation elements. Configurations and operations of the first and second isolation units 350 and 360 are the same as those of the isolation unit 130 shown in FIG. 1 and thus will not be described herein.

The third isolation unit 370 is positioned at a predetermined distance from the first and fourth antenna elements 310 and 340 to prevent the first and fourth antenna elements 310 and 340 from interfering with each other. The fourth isolation unit 380 is positioned at a predetermined distance from the second and third antenna elements 320 and 330 to prevent the second and third antenna elements 320 and 330 from interfering with each other. Configurations and operations of the third and fourth isolation units 370 and 380 are the same as those of the isolation unit 230 shown in FIG. 4 and thus will not be described herein. If the first through fourth isolation units 350 through 380 are disposed as shown in FIG. 9 to prevent the first through fourth antenna elements 310 through 340 from interfering with one another, radiation patterns may be prevented from being distorted or output efficiency may be prevented from being deteriorated.

Values expressed by reference characters e, f, g, h, and i shown in FIG. 9 are relatively determined depending on distances α and β between horizontal and vertical lengths of the first through fourth antenna elements 310 through 340 or the like. In particular, the values expressed by the reference characters f, g, h, and i may be determined by observing the return-loss characteristic with respect to the frequency as shown in FIG. 2, 3, 5, or 6.

Figure 10:
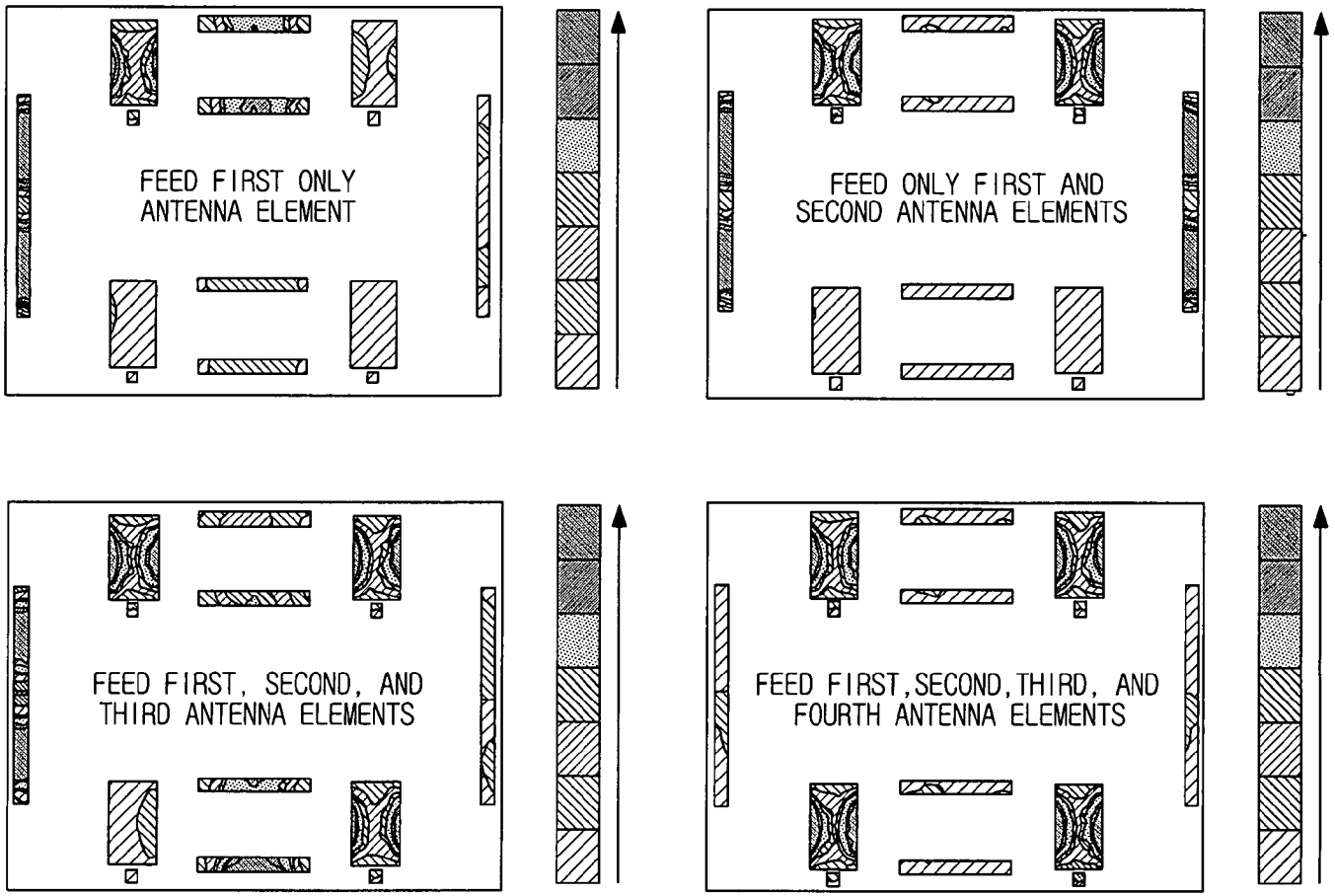
FIG. 10 is a view illustrating a prevention of an interference among first through fourth antenna elements in the plate board type MIMO array antenna of FIG. 9.

FIG. 10 illustrates a prevention of an interference among the first through fourth antenna elements 310 through 340 in the plate board type MIMO array antenna shown in FIG. 9. FIG. 10 shows an operation of the plate board type MIMO array antenna at a central frequency of 5.25 GHz. As shown in FIG. 10, the plate board type MIMO array antenna is increasingly affected by an electromagnetic wave as the pattern of cross-hatching changes in the direction of the arrow.

In a case where only the first antenna element 310 has been fed, an electric field is formed around the first antenna element 310. Referring to FIG. 10, the electromagnetic wave is propagated to the isolation elements 351 and 352 of the first isolation unit 350, the third isolation unit 370, and the second antenna element 320. If the second antenna element 320 is fed in this state, the isolation elements 351 and 352 of the first isolation unit 350 are hardly affected by the electromagnetic wave. This means that the first and second antenna elements 310 and 320 are isolated from each other by the first isolation unit 350.

If the first and second antenna elements 310 and 320 are fed and then the third antenna element 330 is fed, the first through fourth antenna elements 310 through 340 and the first through fourth isolation units 350 through 380 are also affected by the electromagnetic wave. If the fourth antenna element 340 is fed in this state, the first through fourth isolation units 350 through 380 are hardly affected by the electromagnetic wave. Thus, the first through fourth antenna elements 310 through 340 are isolated from one another and thus prevented from interfering with one another.

Figure 11A:
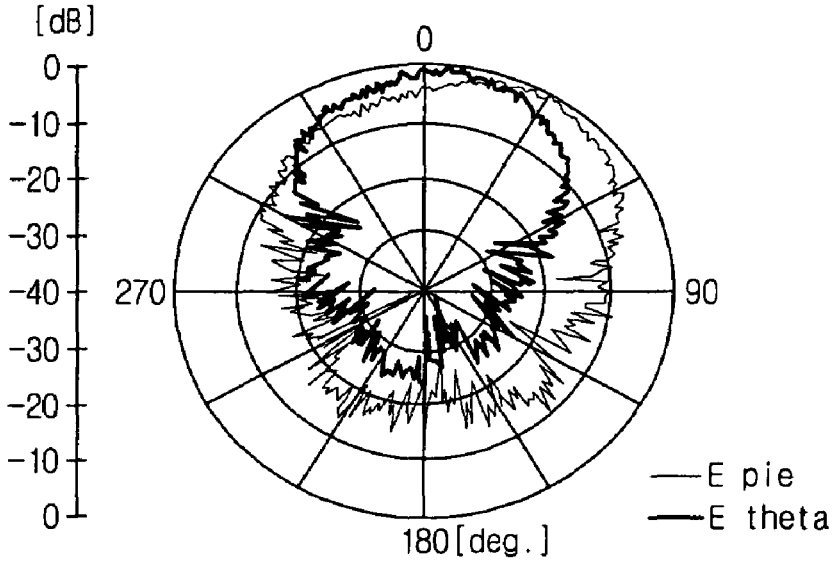
FIGS. 11A to 11D are views illustrating radiation patterns of a conventional MIMO array antenna not including an isolation unit.
Figure 11B:
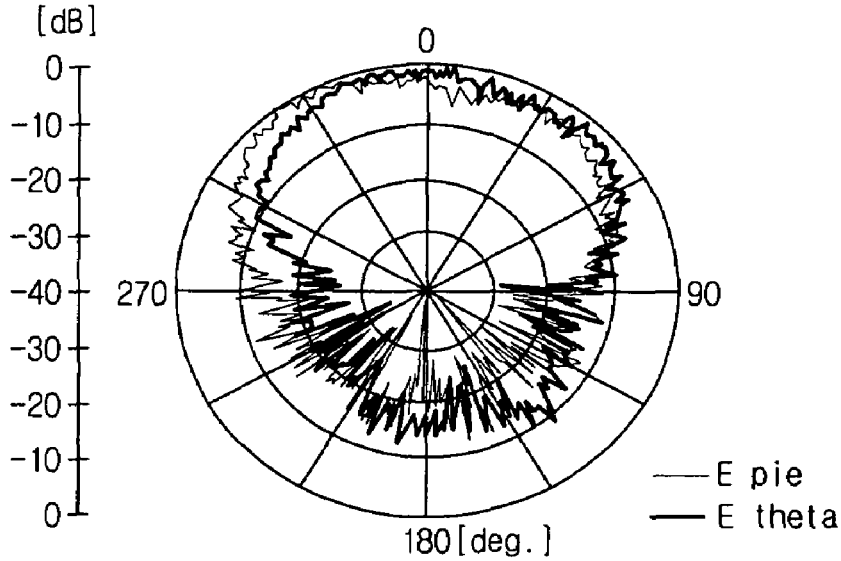
Figure 11C:
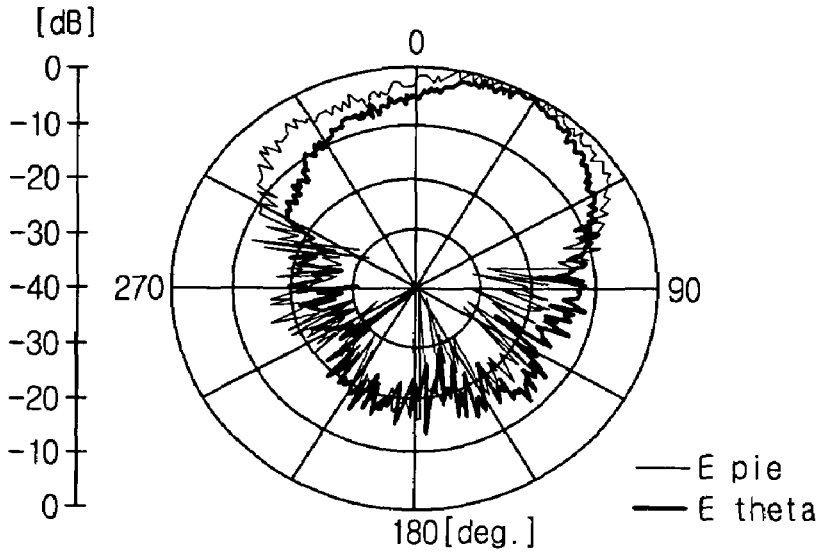
Figure 11D:
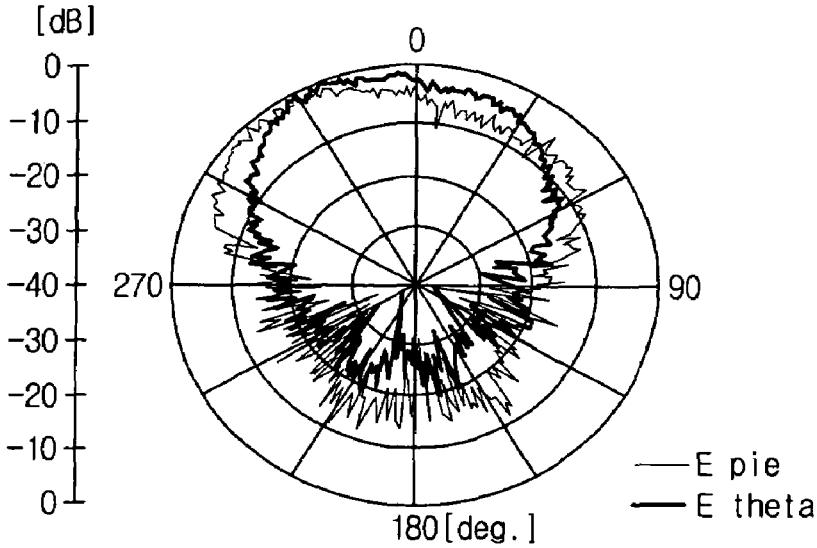
Figure 12A:
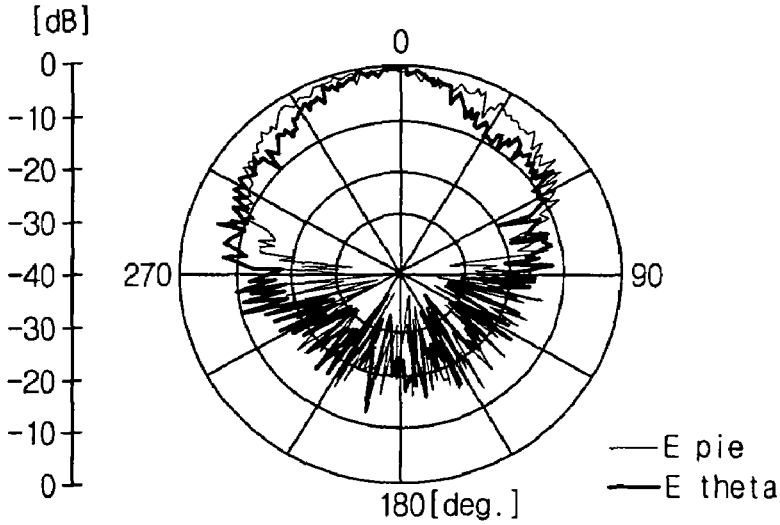
FIGS. 12A to 12D are views illustrating a radiation pattern of the plate board type MIMO array antenna of FIG. 9.
Figure 12B:
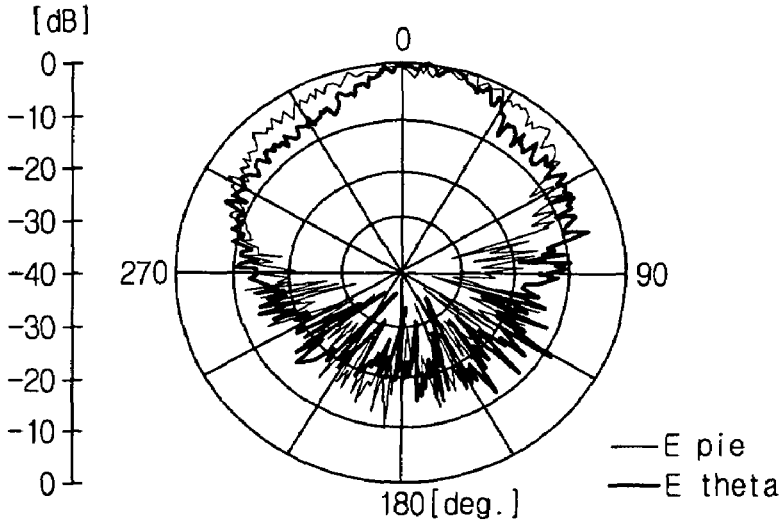
Figure 12C:
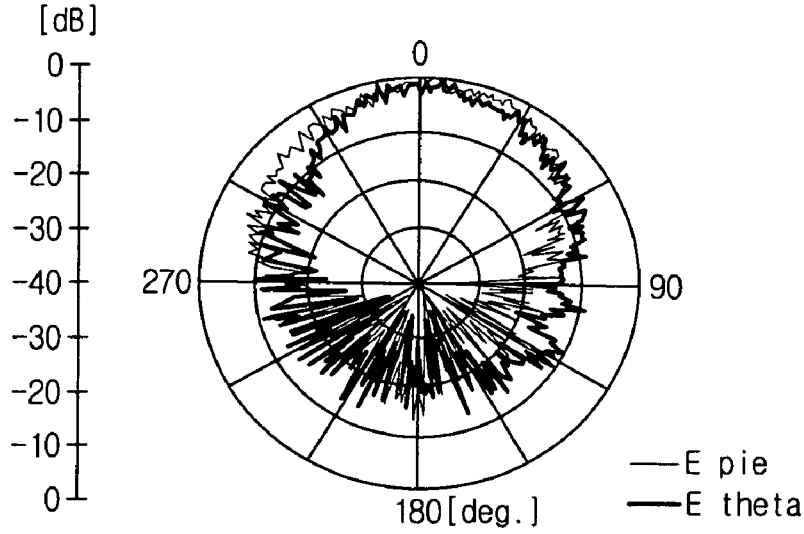
Figure 12D:
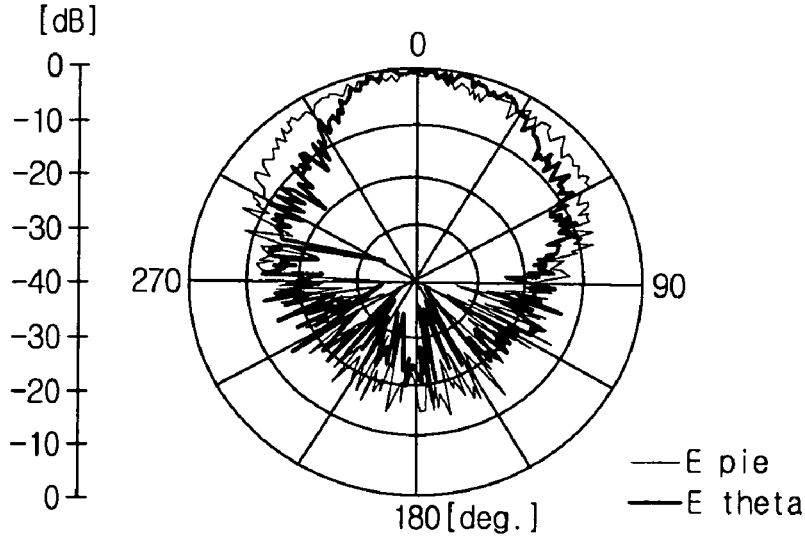

FIGS. 11A to 11D illustrate radiation patterns of the conventional MIMO array antenna not including the isolation unit. Referring to FIG. 11A, a radiation pattern of the first antenna element 310 is distorted at an angle of about 30° on the right side. FIGS. 11B to 11D respectively show that radiation patterns of the second through fourth antenna elements 320 through 340 are distorted on one side based on 0°.

FIGS. 12A to 12D illustrate a radiation pattern of the plate board type MIMO array antenna shown in FIG. 9. FIGS. 12A to 12D respectively show radiation patterns of the first through fourth antenna elements 310 through 340. In FIGS. 12A to 12D, the radiation patterns of the first through fourth antenna elements 310 through 340 face about 0°. In other words, the first through fourth antenna elements 310 through 340 are prevented from interfering with one another by the first through fourth isolation units 350 through 380 so as to prevent the radiation patterns from being distorted.

Figure 13:
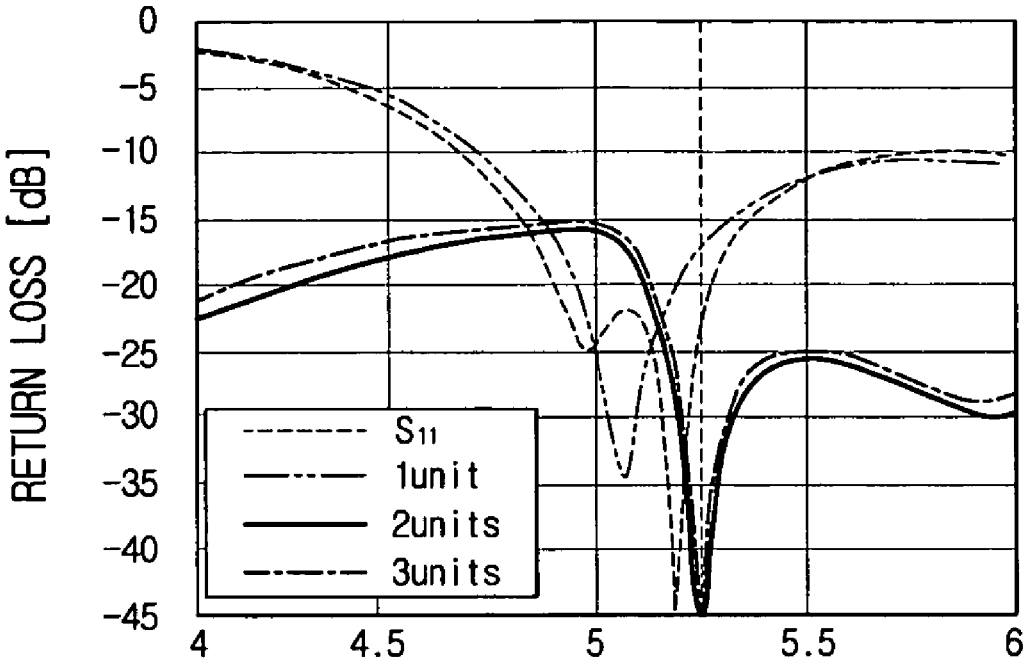
FIG. 13 is a graph illustrating a return-loss characteristic with respect to a frequency depending on a variation in a number of isolation elements in the plate board type MIMO array antenna of FIG. 1.

FIG. 13 is a graph illustrating a return-loss characteristic with respect to a frequency depending on a variation in a number of isolation elements in the plate board type MIMO array antenna shown in FIG. 1. Referring to FIG. 13, in a case where the number of isolation elements is "1," the return-loss is about −35 dB at a frequency of 5.08 GHz. In a case where the number of isolation elements is "2" and "3," the return-loss is about −45 dB, i.e., almost equal. Thus, two or more isolation elements may be disposed between two antenna elements.

As described above, according to exemplary embodiments of the present invention, an isolation unit can be used to prevent antenna elements from interfering with each other. Thus, a radiation pattern can be prevented from being distorted, and an output gain can be increased. Also, metal layers stacked on a board can be etched in predetermined shapes so as to manufacture the isolation unit and the antenna elements. Thus, a method of manufacturing the isolation unit and the antenna elements can be simplified. Since the metal layers on the board constitute the isolation unit, the isolation unit can be almost two-dimensional plate board type. Thus, the isolation unit can be used in a subminiature MIMO system.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A plate board type multiple-input multiple-output (MIMO) array antenna comprising:

a board;

a plurality of antenna elements which are formed on the board and radiate electromagnetic waves;

an isolation unit which comprises an isolation element arranged in an elongated bar configuration among the plurality of antenna elements in a direction identical to a direction in which the antenna elements are arranged, and which offsets effects of the electromagnetic waves on the plurality of antenna elements; and a plurality of feeders which respectively feed the plurality of antenna elements, wherein the plurality of antenna elements comprise a first antenna element and a second antenna element located a predetermined distance from the first antenna element, and wherein the isolation element is divided into two parts of a same length with respect to a center of a distance between the first and second antenna elements.

2. The plate board type MIMO array antenna of claim 1, wherein a distance between central points of the first antenna element and the second antenna element is ½ of a wavelength of a signal the MIMO array antenna desires to output.

3. A plate board type multiple-input multiple-output (MIMO) array antenna comprising:

a board;

a plurality of antenna elements which are formed on the board and radiate electromagnetic waves;

an isolation unit which comprises an isolation element arranged in an elongated bar configuration among the plurality of antenna elements in a direction identical to a direction in which the antenna elements are arranged, and which offsets effects of the electromagnetic waves on the plurality of antenna elements; and a plurality of feeders which respectively feed the plurality of antenna elements, wherein the plurality of antenna elements comprise a first antenna element and a second antenna element located a predetermined distance from the first antenna element, and wherein the isolation unit comprises a plurality of isolation elements positioned within a space between the first and second antenna elements on the board, arranged in an elongated bar configuration parallel to each other in a direction identical to a direction in which the first and second antenna elements are arranged, and symmetric with respect to a center of a distance between the first and second antenna elements, and spaced apart from each other.

4. The plate board type MIMO array antenna of claim 3, wherein each of the plurality of isolation elements has a length corresponding to ½ of a distance between centers of the first and second antenna elements.

5. A plate board type multiple-input multiple-output (MIMO) array antenna, comprising:

a board;

a first antenna element disposed on the board;

a second antenna element disposed a predetermined distance $\alpha$ from the first antenna element on the board;

a third antenna element disposed a predetermined distance $\beta$ from the second antenna element in a direction perpendicular to a direction along which the first and second antenna elements are disposed on the board;

a fourth antenna element disposed at the predetermined distance $\beta$ from the first antenna element and at the predetermined distance $\alpha$ from the third antenna element on the board; and an isolation unit which comprises isolation elements arranged in a bar configuration on one side of each of the first to fourth antenna elements with such a length not to contact an edge of the board, and which offset effects of electromagnetic waves radiated from the first to fourth antenna elements on the first to fourth antenna elements.

6. The plate board type MIMO array antenna of claim 5, wherein the isolation unit comprises a plurality of isolation elements disposed parallel to each other between the first and second antenna elements on the board in a direction identical to a direction in which the first and second antenna elements are arranged, and arranged in a bar configuration symmetric with respect to a center of a distance between the first and second antenna elements, and at a predetermined distance from each other.

7. The plate board type MIMO array antenna of claim 6, wherein the isolation unit further comprises a plurality of isolation elements disposed between the third and fourth antenna elements, in a direction identical to a direction in which the third and fourth antenna elements are arranged, and arranged in a bar configuration symmetric with respect to a center of a distance between the third and fourth antenna elements, and at a predetermined distance from each other.

8. The plate board type MIMO array antenna of claim 7, wherein the isolation unit further comprises an isolation element which is arranged in an elongated bar configuration parallel to the direction in which the first and fourth antenna elements are arranged, at a predetermined distance from an axis on which the first and fourth antenna elements are arranged.

9. The plate board type MIMO array antenna of claim 8, wherein the isolation unit further comprises an isolation element which is arranged in an elongated bar configuration arranged parallel to a direction in which the second and third antenna elements are arranged, at a predetermined distance from an axis on which the second and third antenna elements are arranged.

* * * * *